US007726051B2

(12) United States Patent
Imaizumi et al.

(10) Patent No.: US 7,726,051 B2
(45) Date of Patent: Jun. 1, 2010

(54) WHEEL-TYPE WORKING MACHINE AND METHOD OF CONTROLLING THE SAME

(75) Inventors: Masaaki Imaizumi, Hiratsuka (JP); Tomohide Hamada, Komatsu (JP)

(73) Assignee: Komatsu Ltd., Tokyo (JP)

( * ) Notice: Subject to any disclaimer, the term of this patent is extended or adjusted under 35 U.S.C. 154(b) by 159 days.

(21) Appl. No.: 11/919,181

(22) PCT Filed: Apr. 21, 2006

(86) PCT No.: PCT/JP2006/308408

§ 371 (c)(1),
(2), (4) Date: Dec. 26, 2007

(87) PCT Pub. No.: WO2006/118050

PCT Pub. Date: Nov. 9, 2006

(65) Prior Publication Data

US 2008/0244936 A1 Oct. 9, 2008

(30) Foreign Application Priority Data

Apr. 28, 2005 (JP) ..... 2005-132942

(51) Int. Cl.
*E02F 5/02* (2006.01)

(52) U.S. Cl. ..... 37/348; 60/446

(58) Field of Classification Search ..... 37/348, 37/466, 382, 414, 195, 902; 172/2–11; 60/445, 60/446, 459, 422, 327; 417/1, 212, 213
See application file for complete search history.

(56) References Cited

FOREIGN PATENT DOCUMENTS

| | | | |
|---|---|---|---|
| JP | 1-102249 | U | 7/1989 |
| JP | 4-62236 | A | 2/1992 |
| JP | 4-237724 | A | 8/1992 |
| JP | 5-65724 | A | 3/1993 |
| JP | 2002-285587 | A | 10/2002 |
| JP | 2003-321852 | A | 11/2003 |
| JP | 2004-131208 | A | 4/2004 |

OTHER PUBLICATIONS

Notification Concerning Transmittal of International Preliminary Report on Patentability and Written Opinion, Chapter I of the Patent Cooperation Treaty for PCT/JP2006/308408, 6 sheets.

*Primary Examiner*—Robert E Pezzuto
(74) *Attorney, Agent, or Firm*—Frishauf, Holtz, Goodman & Chick, P.C.

(57) ABSTRACT

A hydraulic excavator includes: an oil-pressure cut valve for suspending pressure oil supply to a PPC valve; a lock switch for operating the oil-pressure cut valve; and a control device for controlling a switching of the oil-pressure cut valve. The control device includes: a lock-state determining unit that determines a lock state of working equipment by considering the status of the lock switch; a traveling-state determining unit that determines a traveling state of the hydraulic excavator; an alert-issuing controlling unit that issues an alert urging locking of the working equipment; and a relay control unit that actuates the oil-pressure cut valve to suspend the flow of pressure oil. The alert-issuing controlling unit issues the alert and the relay control unit actuates the oil pressure cut valve when the hydraulic excavator is determined to be traveling and the working equipment is determined not to be in the lock state.

7 Claims, 5 Drawing Sheets

WHEEL-TYPE WORKING MACHINE AND METHOD OF CONTROLLING THE SAME

This application is a U.S. National Phase Application under 35 USC 371 of International Application PCT/JP2006/308408 filed Apr. 21, 2006.

TECHNICAL FIELD

The present invention relates to a wheeled work machine, a representative example of which is a wheeled hydraulic excavator travelable on a public road, and to a control method of the same.

BACKGROUND ART

There has been conventionally known a wheeled hydraulic excavator that uses wheels for traveling on a public road instead of using a crawler-type lower traveling body. Like a general hydraulic excavator, such a hydraulic excavator includes an upper swing body rotated by a hydraulic motor, and a boom, an arm, a bucket and the like that are actuated by respective hydraulic cylinders. The boom and the bucket are operated by one working equipment lever provided in a cab while the rotary body and the arm are operated by the other working equipment lever provided in the cab.

In such a wheeled hydraulic excavator, even if an operator inadvertently touches the working equipment lever while traveling on a public road, a working equipment (including: the hydraulically-driven rotary body, and the boom, the arm, the bucket and the like driven by the hydraulic cylinders) is arranged not to be actuated. In other words, an oil-pressure cut valve is provided in the middle of a hydraulic circuit for supplying pressure oil to the hydraulic motor and the hydraulic cylinders, and the oil-pressure cut valve is switched by a lock switch provided on an operational panel. With this arrangement, the operator turns on the lock switch to suspend the pressure oil supply in traveling on a public road, whereby the working equipment is prevented from being actuated even if the operator carelessly touches the working equipment lever (e.g., see Patent Document 1).

[Patent Document 1] JP-A-05-65724

DISCLOSURE OF THE INVENTION

Problems to be Solved by the Invention

However, since the lock switch is voluntarily operated by a human (i.e., the operator), the pressure oil may be continuously supplied to the hydraulic motor and the hydraulic cylinders in a case where the operator forgets to operate the lock switch, whereby the working equipment may be actuated by touching the working equipment lever. Accordingly, there has been a demand for avoiding such a problem.

An object of the present invention is to provide a wheeled work machine and a controlling method of the same that can automatically suspend pressure oil supply to a working equipment by detecting a traveling state.

Means for Solving the Problems

A wheeled work machine according to an aspect of the present invention includes: a working equipment that is hydraulically driven; an oil-pressure cut valve adapted to switch to supply or to suspend pressure oil to the working equipment; a lock switch that makes the oil-pressure cut valve perform a switching; and a control device that controls the switching of the oil-pressure cut valve, in which the control device includes: a lock-state judging means that judges a lock state of the working equipment by the lock switch; a traveling-state judging means that judges whether or not the work machine is traveling; and an alert-issuing controlling means that issues an alert urging that the working equipment be locked by an operation of the lock switch when the work machine is judged to be traveling by the traveling-state judging means and the working equipment is judged to be not in the lock state by the lock-state judging means.

A wheeled work machine according to another aspect of the present invention includes: a working equipment that is hydraulically driven; an oil-pressure cut valve adapted to switch to supply or to suspend pressure oil to the working equipment; a lock switch that makes the oil-pressure cut valve perform a switching; and a control device that controls the switching of the oil-pressure cut valve, in which the control device includes: a lock-state judging means that judges a lock state of the working equipment by the lock switch; a traveling-state judging means that judges whether or not the work machine is traveling; and a lock control means that actuates the oil-pressure cut valve to suspend the pressure oil when the work machine is judged to be traveling by the traveling-state judging means and the working equipment is judged to be not in the lock state by the lock-state judging means.

A wheeled work machine according to a still further aspect of the present invention includes: a working equipment that is hydraulically driven; an oil-pressure cut valve adapted to switch to supply or to suspend pressure oil to the working equipment; a lock switch that makes the oil-pressure cut valve perform a switching; and a control device that controls the switching of the oil-pressure cut valve, in which the control device includes: a lock-state judging means that judges a lock state of the working equipment by the lock switch; a traveling-state judging means that judges whether or not the work machine is traveling; an alert-issuing controlling means that issues an alert urging that the working equipment be locked by an operation of the lock switch when the work machine is judged to be traveling by the traveling-state judging means and the working equipment is judged to be not in the lock state by the lock-state judging means; and a lock control means that actuates the oil-pressure cut valve to suspend the pressure oil when the work machine is judged to be traveling by the traveling-state judging means and the working equipment is judged to be not in the lock state by the lock-state judging means.

According to the aspects of the present invention, the wheeled work machine preferably includes a speed sensor that detects a traveling speed of the work machine, in which the traveling-state judging means judges whether or not the work machine is traveling based on a detection signal from the speed sensor.

A controlling method of a wheeled work machine according to a still further aspect of the present invention is a controlling method for a wheeled work machine that includes: a working equipment hydraulically driven; an oil-pressure cut valve adapted to switch to supply or to suspend pressure oil to the working equipment; a lock switch that makes the oil-pressure cut valve perform a switching; and a control device that controls the switching of the oil-pressure cut valve, the control device performing: a step to judge a lock state of the working equipment by the lock switch; a step to judge whether or not the work machine is traveling, the control device further performing at least one of: a step to issue an alert urging that the working equipment be locked by operating the lock switch; and a step to actuate the oil-pressure cut valve to suspend the pressure oil, when the work machine is judged to be traveling and the working equipment is judged to be not in the lock state.

According to the wheeled work machines and the controlling method of the same of the aspects of the present invention, in a case where the operator of the wheeled work machine forgets to operate the lock switch in starting the traveling and fails to lock the working equipment, the control device issues the alert to notice that the working equipment is not locked or automatically locks the working equipment when judging that the work machine is traveling. With this arrangement, even when the operator inadvertently touches a working equipment lever during the traveling, the actuation of the working equipment can be reliably prevented.

EXPLANATION OF CODES

Figure 1:
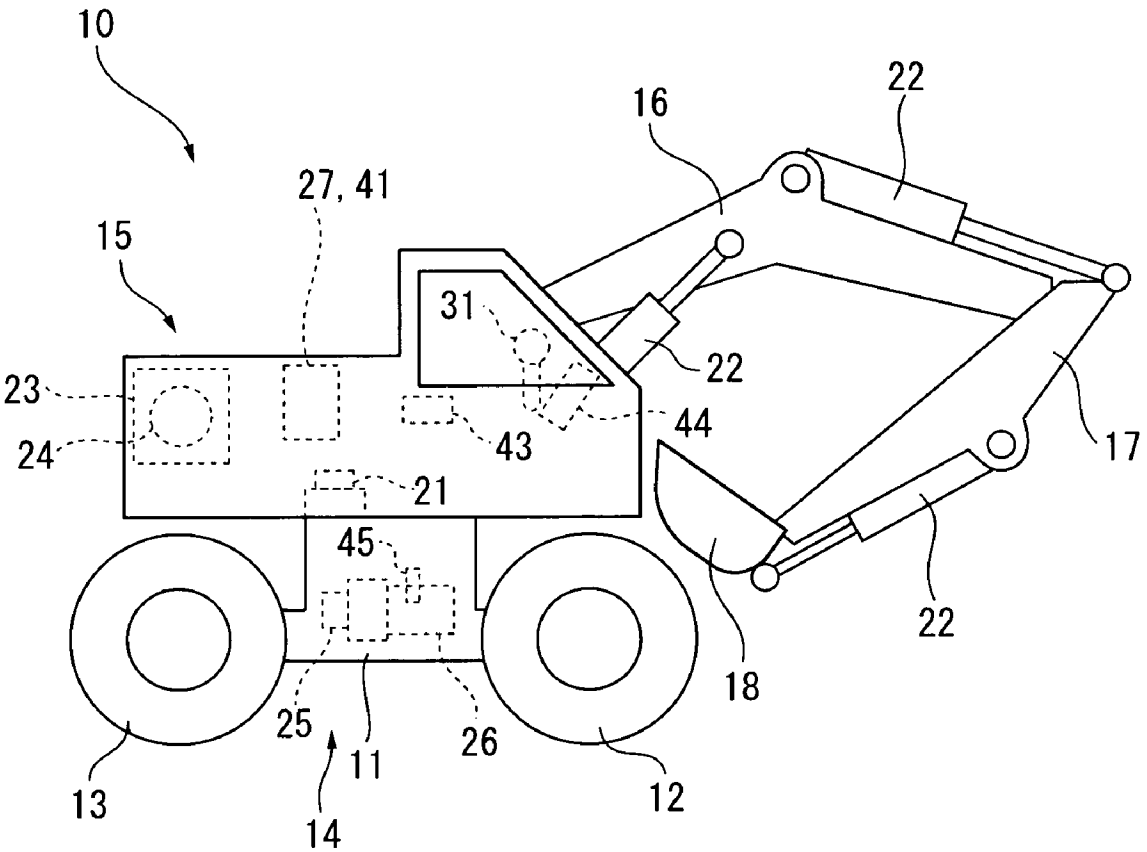
FIG. 1 is a schematic view showing a wheeled work machine according to an embodiment of the present invention.

10: hydraulic excavator (wheeled work machine)
15: upper swing body
16: boom
17: arm
18: bucket
21: hydraulic motor
22: hydraulic cylinder
40: working-equipment locking system
41: oil-pressure cut valve
44A: lock switch
51: lock-state judging means
52: relay control means (lock control means)
56: traveling-state judging means
57: alert-issuing controlling means

BEST MODE FOR CARRYING OUT THE INVENTION

An embodiment of the present invention will be described below with reference to the attached drawings.

Figure 2:
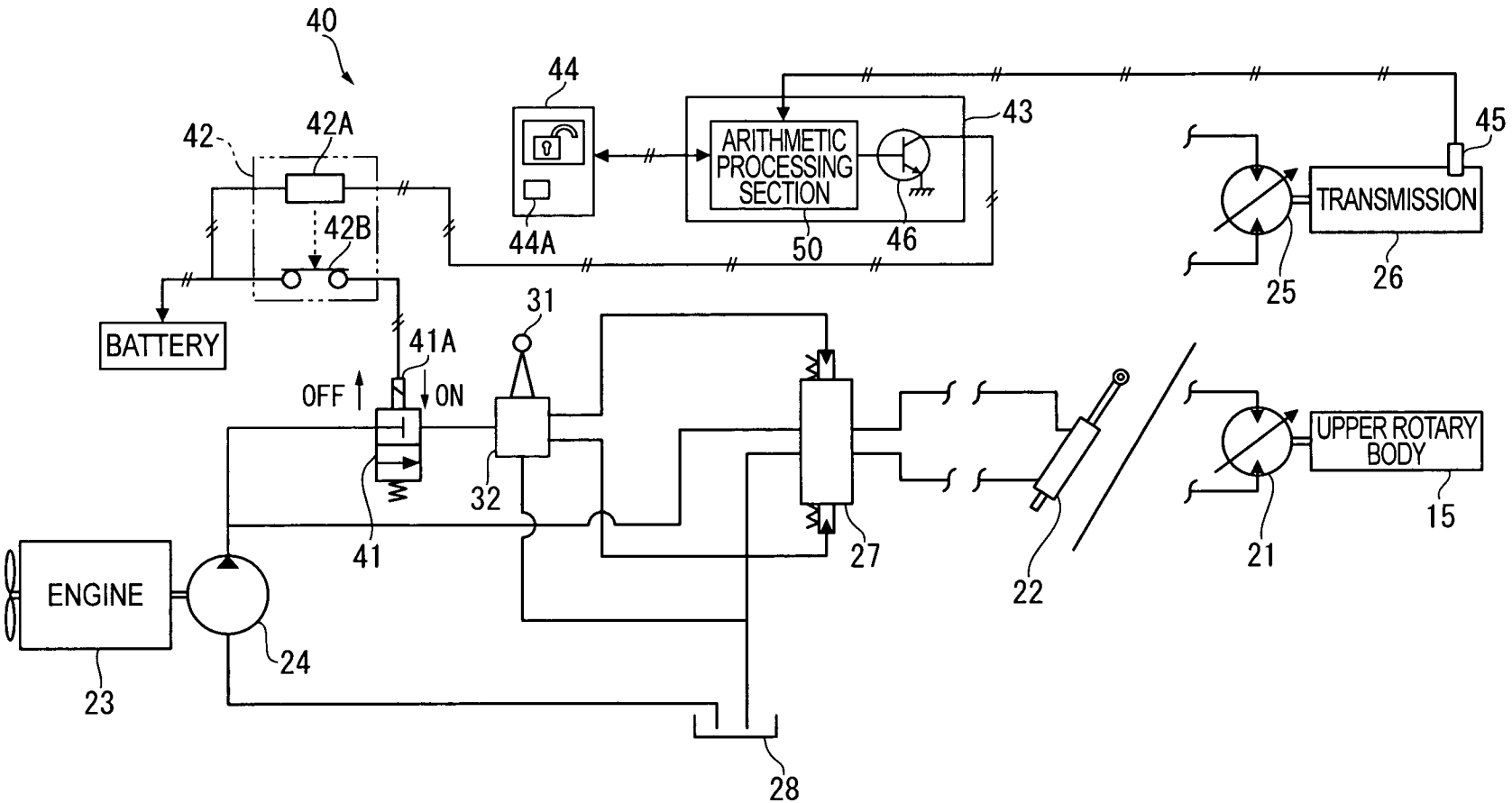
FIG. 2 is a hydraulic and electric circuit diagram showing a working-equipment locking system for the wheeled work machine.
Figure 3:
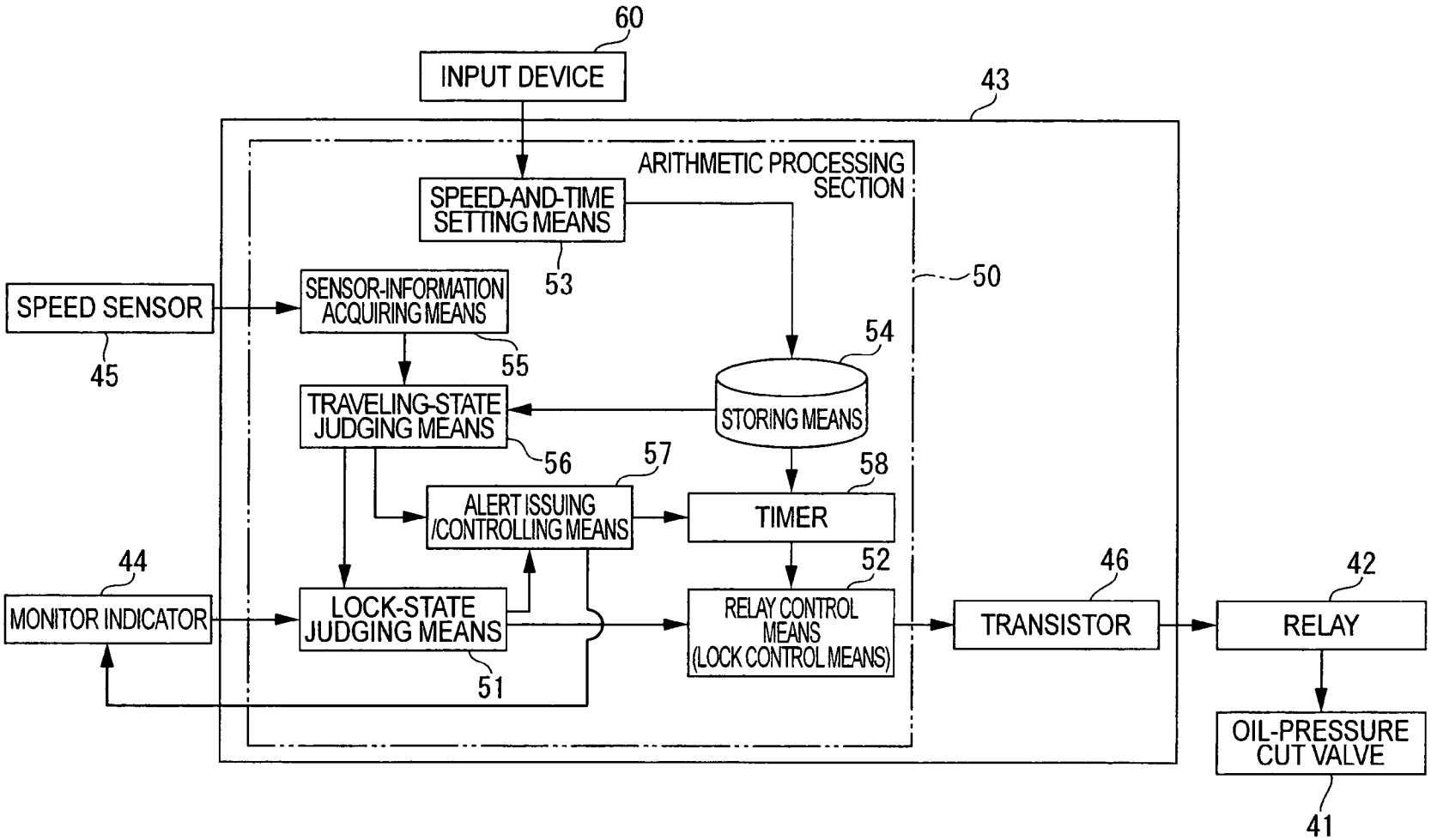
FIG. 3 is a control block diagram showing a control device installed in the wheeled work machine.
Figure 4:
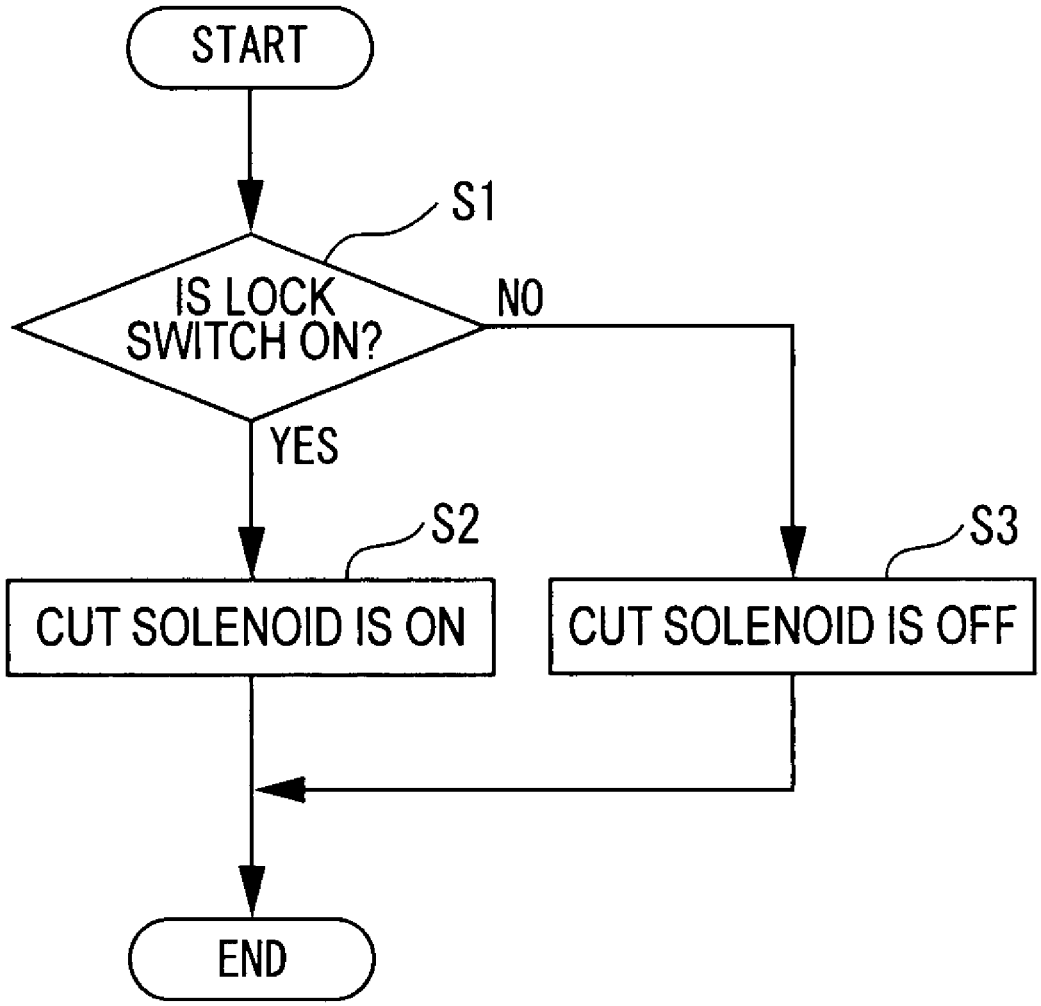
FIG. 4 is a flow chart explaining a control method of a working equipment in the wheeled work machine.
Figure 5:
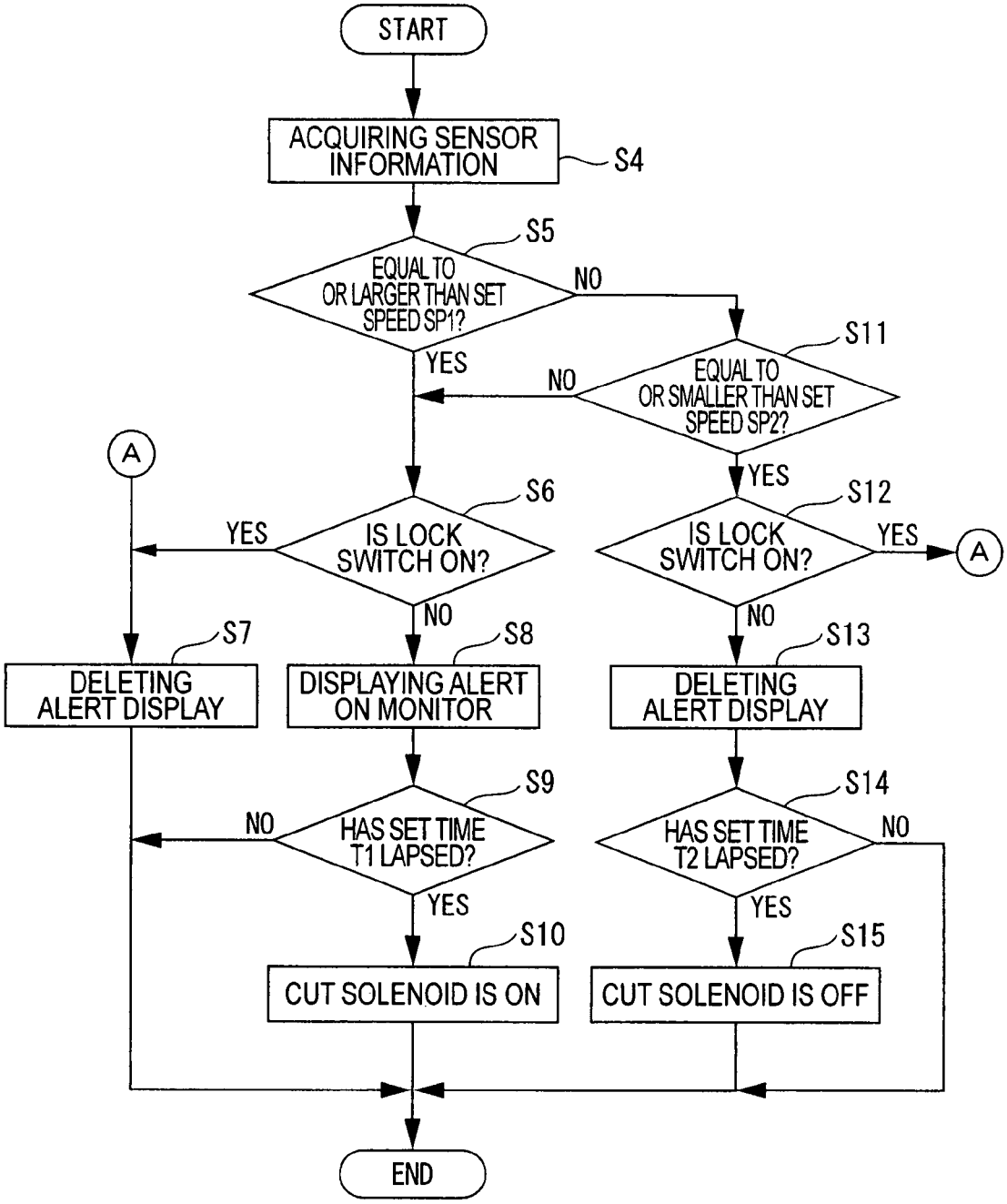
FIG. 5 is another flow chart explaining a control method of the working equipment in the wheeled work machine.

FIG. 1 is a schematic view showing a hydraulic excavator 10 (wheeled work machine) according to the present embodiment. FIG. 2 is a hydraulic and electric circuit diagram showing a working-equipment locking system 40 for the hydraulic excavator 10. FIG. 3 is a control block diagram showing a control device 43 installed in the hydraulic excavator 10. FIGS. 4 and 5 are flow charts explaining a control method of a working equipment in the hydraulic excavator 10.

In FIG. 1, the hydraulic excavator 10 includes a lower traveling body 14 in which a pair of front wheels 12 and a pair of rear wheels 13 are mounted to a truck frame 11 (only one front wheel and one rear wheel are shown), whereby the hydraulic excavator 10 is adapted to travel on a general public road. An upper swing body 15 is rotatably mounted on an upper side of the lower traveling body 14 via a swing circle (not shown). The upper swing body 15 includes a boom 16, an arm 17 and a bucket 18.

The upper swing body 15 is driven by a hydraulic motor 21 while the boom 16, the arm 17 and the bucket 18 are driven by hydraulic cylinders 22 which are respectively provided. The upper swing body 15, the boom 16, the arm 17 and the bucket 18 as well as the hydraulic motor 21 and the hydraulic cylinders 22 are included in a working equipment according to the present invention. Pressure oil is supplied to the hydraulic motor 21 and the hydraulic cylinders 22 by a hydraulic pump 24 driven by an engine 23 as shown in FIG. 2. Pressure oil from the hydraulic pump 24 is also supplied to a hydraulic motor 25 inside the lower traveling body 14 (FIG. 1) and outputs from the hydraulic motor 25 are transmitted to the wheels 12, 13 via a transmission 26.

More specifically, as shown in FIG. 2, the pressure oil from the pressure pump 24 is supplied to the hydraulic motor 21 and the hydraulic cylinders 22 through a control valve 27 while the supplied pressure oil is returned to a hydraulic oil tank 28 through the control valve 27. Incidentally, although the hydraulic motor 21 and each of the hydraulic cylinders 22 are provided with the control valve 27, FIG. 2 shows only one control valve 27 to simplify the description.

The control valve 27 for actuating the working equipment is switched by a proportional pressure control valve 32 (PPC valve) for outputting a pilot pressure in accordance with an operational amount on a working equipment lever 31. Although two working equipment levers 31 are provided: one for operating the boom 16 and the bucket 18; and one for operating the upper swing body 15 and the arm 17, FIG. 2 only shows one of the working equipment levers 31 for a simplification.

The thus-arranged hydraulic excavator 10 includes a working-equipment lock system 40 for preventing the working equipment from being inadvertently actuated while the hydraulic excavator 10 is traveling on a public road.

The working-equipment lock system 40 includes: a oil-pressure cut valve 41 provided between the hydraulic pump 24 and the PPC valve 32; a relay 42 for operating a cut solenoid 41A of the oil-pressure cut valve 41; a control device 43 including a computer for controlling a switch of the oil-pressure cut valve 41; a monitor indicator 44 provided inside a cab; and a speed sensor 45 mounted to the transmission 26 to detect a traveling speed.

Further, the working-equipment locking system 40 according to the present embodiment is capable of: manually locking the working equipment by a manual operation by an operator; automatically locking the working equipment when predetermined conditions such as a traveling speed are satisfied; and manually or automatically releasing a lock state of the working equipment.

First of all, the manual locking by the operation by the operator is performed by pressing a lock switch 44A provided to the monitor indicator 44. In other words, in starting traveling, the operator presses the lock switch 44A. Then, the monitor indicator 44 outputs a high-level lock signal to an arithmetic processing section 50 provided in the control device 43. A display panel of the monitor indicator 44 screen-displays an ON-state of the lock switch 44A.

As shown in FIG. 3, the arithmetic processing section 50 is provided with a lock-state judging means 51 monitoring the lock signal. The lock-state judging means 51 outputs a control signal to a relay control means 52 (lock control means) when the high-level lock signal is input thereto. The relay control means 52 applies a driving voltage to the relay 42 via a transistor 46. Then, a switch 42B of the relay 42 is turned on to move the cut solenoid 41A in an ON direction, such that the oil-pressure 41 stops the pressure oil supply to the PPC valve 32.

Manually releasing the lock state requires the lock switch 44A to be pressed again, whereby the lock signal becomes a low level. The lock-state judging means 51 monitoring the lock signal outputs another control signal to the relay control means 52, such that the relay control means 52 stops the supply of the driving voltage to the relay 42. Subsequently, the switch 42B of the relay 42 is turned off to return the cut solenoid 41A in an OFF direction. Then, the pressure oil supply to the PPC valve 32 is re-started.

The above operations will be described with reference to the flow chart shown in FIG. 4. Initially, the lock-state judging means 51 of the arithmetic processing section 50 monitors the lock signal from the lock switch 44A to judge whether or not the lock switch 44A is on (Step 1: hereinafter, the "step" will be referred to as "S"). When the lock switch 44A is on, the relay control means 52 actuates the relay 42 to bring the cut solenoid 41A into the ON-state (S2). In contrast, when the lock switch 44A is off, the relay control means 52 stops applying the voltage to the relay 42 to bring the cut solenoid 41A into the OFF-state (S3).

An automatic locking and unlocking of the working equipment will be described below. In order to automatically lock and unlock the working equipment, the arithmetic processing section 50 of the control device 43 includes following means in addition to the lock-state judging means 51 and the relay control means 52 described above. The following means are configured as software (computer program) to be processed within the arithmetic processing section 50 or as hardware to constitute the arithmetic processing section 50.

Specifically, the arithmetic processing section 50 includes a speed-and-time setting means 53, a storing means 54, a sensor-information acquiring means 55, a traveling-state judging means 56, an alert-issuing controlling means 57 and a timer 58 as shown FIG. 3.

The speed-and-time setting means 53 is capable of setting a traveling speed that is used as a threshold value for judging whether or not the hydraulic excavator 10 is traveling. In the present embodiment, a set speed SP1 and a set speed SP2 are set. The set speed SP1 is larger than the set speed SP2. The speed-and-time setting means 53 is further capable of setting time periods (set time) T1, T2 until the time is up for the timer 58. Although already written in the storing means 54 as data when the hydraulic excavator 10 is shipped from a work site in the present embodiment, the set speeds SP1, SP2 and the set time T1, T2 may be input and set at any time by an appropriate input device 60 such as a personal computer.

Specifically, the set speed SP1 may be set at 11 km/h while the set speed SP2 may be set at 9 km/h in the present embodiment although the above values may not be necessarily employed. In other words, when a speed that is equal to or larger than the set speed SP1 (11 km/h) is detected by the speed sensor 45, the hydraulic excavator 10 is judged to be traveling. Note that the set speed SP2 is set to prevent the judging results from being varied too frequently depending on minor variations in the traveling speed around the set speed SP1.

The storing means 54, which is configured to be a recording medium such as ROM, stores the set speeds SP1, SP2 and the set time T1, T2.

The sensor-information acquiring means 55 is capable of receiving a detection signal from the speed sensor 45.

The traveling-state judging means 56 compares an actual speed according to the detection signal from the speed sensor 45 with the set speeds SP1, SP2 having been set in advance to judge whether or not the hydraulic excavator 10 is traveling.

The alert-issuing controlling means 57 outputs an alert signal to the monitor indicator 44 to alert the operator through an alert displayed on the monitor panel, a sound and the like when the lock switch 44A is not in the ON-state even though the hydraulic excavator 10 is traveling (i.e., when the lock switch 44A has not been pressed e.g. because the operator forgot to do so). When the alert display becomes no longer necessary while the alert display is displayed thereon, the alert-issuing controlling means 57 is also capable of deleting the alert display.

The timer 58 is capable of counting elapse time after the alert signal is output and time after the alert display is deleted.

When the OFF-state of the lock switch 44A is maintained even after the set time T1 lapses although the hydraulic excavator 10 is traveling, the above-described relay control means 52 suspends the pressure oil supply to the PPC valve 32 by controlling the relay 42 to be turned on, and forcibly locks the working equipment to prevent the working equipment from being actuated by an operation on the working equipment lever 31.

Based on the flow chart shown in FIG. 5 will be described the mandatory automatic locking and unlocking when the operator fails to lock the working equipment.

Initially, the sensor-information acquiring means 55 is actuated to acquire the detection signal from the speed sensor 45 (S4). Then, the traveling-state judging means 56 compares the actual speed according to the detection signal with the set speed SP1 stored in the storing means 54 to judge whether or not the hydraulic excavator 10 is traveling on a public road (S5).

When it is judged that the actual speed is equal to or larger than the set speed SP1 and that the hydraulic excavator 10 is traveling on a public road as a result of the judging in S5, the lock-state judging means 51 detects operating states of the lock switch 44A to judge the lock state of the working equipment (S6). The lock state can be judged by detecting the lock signal from the monitor indicator 44. When the lock switch 44A is on and the lock signal is at a high level, it can be judged that the working equipment is in the lock state with the pressure oil supply being suspended by the oil-pressure cut valve 41. When the working equipment is in the lock state, the alert-issuing controlling means 57 outputs to the monitor indicator 44 a signal for deleting the alert having been displayed (S7). However, since the alert display is not displayed herein, the process is terminated to return to S4, from which the process is repeated.

On the other hand, when the working equipment is not in the lock state in S6, the working equipment is not locked even though the hydraulic excavator 10 is traveling. Hence, the alert-issuing controlling means 57 outputs the alert signal to the monitor indicator 44, such that the alert is displayed in the monitor indicator 44 (S8). Subsequently alerted to notice that the lock switch 44A has not been operated, the operator immediately can operate the lock switch 44A.

Next, the timer 58, which is actuated after the alert signal is output, counts time until the set time T1 having been set in advance lapses (S9). Before the set time T1 lapses, the process is terminated to return to S4, from which the process is repeated. When the judgment in S6 that the working equipment is not in the lock state is maintained even after the set time T1 has lapsed, it is judged that the hydraulic excavator 10 continues to be traveling with the lock switch 44A not being operated due to the operator's failure to notice the alert display. The relay control means 52 subsequently moves the cut solenoid 41A to the ON side via the transistor 46 and the relay 42 (S10) to forcibly suspend the pressure oil supply to the PPC valve 32 using the oil-pressure cut valve 41, whereby the working equipment is automatically locked. With this arrangement, even when the operator forgets to operate the lock switch 44A in starting a traveling of the hydraulic excavator 10 on a public road and fails to notice that the lock switch 44A is not operated during the traveling, since the working equipment is automatically locked while the hydraulic excavator 10 is traveling, the working equipment is not actuated even when the operator touches the working equipment lever 31 during the traveling.

However, even when the working equipment is forcibly locked, the step flow of S4 to S10 will be repeated in the next process re-starting from S4 until the operator turns on the lock switch 44A, whereby the alert-issuing controlling means 57 continues to display the alert on the monitor indicator 44. The above-described arrangement is intended to raise the operator's awareness of the working equipment locking. Then, once the operator turns on the lock switch 44A, the step flow proceeds from S6 to S7, whereby the alert-issuing controlling means 57 deletes the alert display on the monitor indicator 44.

When the actual speed is smaller than the set speed SP1 in S5, the traveling-state judging means 56 compares the actual speed with the set speed SP2 (S11). As long as the actual speed is equal to or larger than the set speed SP2 even when the actual speed is smaller than the set speed SP1, the traveling-state judging means 56 judges that the hydraulic excavator 10 is traveling on a public road. In an arrangement where the judgment is only based on the set speed SP1, since the judgment result may too frequently vary due to a slight variation in the actual speed when the traveling of the hydraulic excavator 10 is continued at around the set speed SP1, a stable control may not be performed. In contrast, with the actual speed being also compared with the set speed SP2, the variation in the actual speed can be absorbed, whereby a stable control can be performed.

When the actual speed is equal to or smaller than the set speed SP2 in S11, the traveling-state judging means 56 judges that the hydraulic excavator 10 is not traveling on a public road. The lock-state judging means 51 subsequently detects again the operational states of the lock switch 44A (S12). When the lock switch 44A is in the ON-state at this stage, the process proceeds to S7, such that the alert-issuing controlling means 57 deletes the alert when the alert is being displayed. The lock switch 44A being in the ON-state at this stage means that, although the hydraulic excavator 10 is not traveling on a public road, the operator keeps the lock switch 44A locked for safety, such that the lock state of the working equipment is maintained. In short, returning to S4 from S7, the process is repeated.

In contrast, the lock switch 44A can be in an OFF-state in S12. The lock switch 44A being in the OFF-state means that the operator has been continuously unaware of the alert throughout the traveling on a public road, and that the traveling on a public road has been subsequently terminated. Even in the above-described case, based on the termination of the traveling on a public road, the alert-issuing controlling means 57 outputs to the monitor indicator 44 a signal to delete the alert display, thereby deleting the alert display (S13). The steps of S12 and S13 are performed when the hydraulic excavator 10 has not been traveling from the first time. However, in this case, since no alert is displayed from the beginning, the state where no alert is displayed is maintained in S13.

Then, the timer 58 is actuated to judge whether or not the set time T2 has lapsed (S14). Before the set time T2 lapses, the process is terminated to return to S4, from which the process is repeated. When the set time T2 has lapsed in S14, it is judged to be obvious that the hydraulic excavator 10 is not traveling on a public road. Note that, when the hydraulic excavator 10 is judged to have started traveling based on the judging results in S5 and S11 while the set time T2 is yet to lapse, S6 and the subsequent steps are performed.

In addition, when the set time T2 has lapsed while the lock switch 44A in the OFF-state, the relay control means 52 moves the cut solenoid 41A to an OFF side via the transistor 46 and the relay 42 (S15) to re-start the pressure oil supply to the PPC valve 32 from the oil-pressure cut valve 41, whereby the lock state of the working equipment is automatically released. When the lock state has been kept released from the beginning, a state where the working equipment is unlocked is maintained.

As described above, in a case where the operator of the hydraulic excavator 10 forgets to operate the lock switch 44A in starting the traveling and fails to lock the working equipment, the control device 43 issues the alert to notice that the working equipment is not locked when judging that the hydraulic excavator 10 is traveling, and automatically locks the working equipment after predetermined time has lapsed. With this arrangement, even when the operator carelessly touches the working equipment lever 31 during the traveling, the actuation of the working equipment can be reliably prevented.

According to the present embodiment, when the operator locks the working equipment by operating the lock switch 44A, the working equipment cannot be unlocked unless the operator operates the lock switch 44A again. In other words, the working equipment is not automatically unlocked by the control device 43 when the operator intentionally locks the working equipment, thereby preventing an unintentional unlocking of the working equipment.

Incidentally, the present invention is not limited to the embodiment described above, but includes other arrangements as long as an object of the present invention can be achieved, which also includes the following modification.

For instance, although the pressure oil supply to the PPC valve 32 is stopped to make the working equipment lever 31 inoperative in order to lock the working equipment in the above embodiment, the present invention is not limited thereto but may include an arrangement in which an oil-pressure cut valve is provided between the control valve 27 and the working equipment so as to lock the working equipment.

In the above embodiment, when the hydraulic excavator 10 is traveling with the lock switch 44A not being operated due to the operator's failure to do so, the control device 43 initially controls the monitor indicator 44 to display the alert, and the working equipment is subsequently controlled to be forcibly locked when the operator still fails to operate the lock switch 44A even after the set time T1 has lapsed since the alert was displayed. However, the present invention may include an arrangement in which the monitor indicator 44 is only controlled to display the alert or an arrangement in which the working equipment is forcibly locked without any alert displayed.

Although the best arrangement and method for implementing the present invention has been disclosed above, the present invention is not limited thereto. In other words, while the present invention has been described with reference to the specific embodiments and the drawings thereof, various modifications may be made to the disclosed embodiments by those of ordinary skill in the art without departing from the spirit and scope of the invention.

Therefore, the description that limits the shape and the quantity is only an example to make the invention easily understood, but is not intended to limit the invention, so that the invention includes the description using a name of component without a part of or all of the limitation on the shape and the material etc.

INDUSTRIAL APPLICABILITY

The present invention is applicable not only to a hydraulic excavator but also to a wide variety of wheeled work machines travelable on a public road such as a wheeled rough terrain crane, a motor grader or the like. Incidentally, in a motor grader, which performs most of the operations while traveling, it is preferable to conduct a displaying of an alert to notice that a working equipment is not locked or an automatic locking of the working equipment only when the motor grader is traveling on a public road without performing any operations.

The invention claimed is:

1. A wheeled work machine, comprising:

a working equipment that is hydraulically driven;

an oil-pressure cut valve adapted to switch between a supply state in which pressurized oil is supplied to the working equipment and a suspension state in which the supply of pressurized oil to the working equipment is suspended;

a lock switch that makes the oil-pressure cut valve perform the switching between the supply state and the suspension state; and a control device that controls the switching of the oil-pressure cut valve, wherein the control device includes:

lock-state judging means for judging a lock state of the working equipment by considering the status of the lock switch;

traveling-state judging means for judging whether or not the work machine is traveling; and alert-issuing controlling means for issuing an alert urging that the working equipment be locked by an operation of the lock switch when the work machine is judged to be traveling by the traveling-state judging means and the working equipment is judged not to be in the lock state by the lock-state judging means.

2. The wheeled work machine according to claim 1, further comprising:

a speed sensor that detects a traveling speed of the work machine, wherein the traveling-state judging means judges whether or not the work machine is traveling based on a detection signal from the speed sensor.

3. A wheeled work machine, comprising:

a working equipment that is hydraulically driven;

an oil-pressure cut valve adapted to switch between a supply state in which pressurized oil is supplied to the working equipment and a suspension state in which the supply of pressurized oil to the working equipment is suspended;

a lock switch that makes the oil-pressure cut valve perform the switching between the supply state and the suspension state; and a control device that controls the switching of the oil-pressure cut valve, wherein the control device includes:

lock-state judging means for judging a lock state of the working equipment by considering the status of the lock switch;

traveling-state judging means for judging whether or not the work machine is traveling;

alert-issuing controlling means for issuing an alert urging that the working equipment be locked by an operation of the lock switch when the work machine is judged to be traveling by the traveling-state judging means and the working equipment is judged not to be in the lock state by the lock-state judging means; and lock control means for actuating the oil-pressure cut valve to suspend the pressure oil when the work machine is judged to be traveling by the traveling-state judging means and the working equipment is judged not to be in the lock state by the lock-state judging means.

4. The wheeled work machine according to claim 3, further comprising:

a speed sensor that detects a traveling speed of the work machine, wherein the traveling-state judging means judges whether or not the work machine is traveling based on a detection signal from the speed sensor.

5. A wheeled work machine, comprising:

a working equipment that is hydraulically driven;

an oil-pressure cut valve adapted to switch between a supply state in which pressurized oil is supplied to the working equipment and a suspension state in which the supply of pressurized oil to the working equipment is suspended;

a lock switch that makes the oil-pressure cut valve perform the switching between the supply state and the suspension state; and a control device that controls the switching of the oil-pressure cut valve, wherein the control device includes:

lock-state judging means for judging a lock state of the working equipment by considering the status of the lock switch;

traveling-state judging means for judging whether or not the work machine is traveling; and lock control means for actuating the oil-pressure cut valve to suspend the pressure oil when the work machine is judged to be traveling by the traveling-state judging means and the working equipment is judged not to be in the lock state by the lock-state judging means.

6. The wheeled work machine according to claim 2, further comprising:

a speed sensor that detects a traveling speed of the work machine, wherein the traveling-state judging means judges whether or not the work machine is traveling based on a detection signal from the speed sensor.

7. A method for controlling a wheeled work machine, the work machine including:

a working equipment that is hydraulically driven;

an oil-pressure cut valve adapted to switch between a supply state in which pressurized oil is supplied to the working equipment and a suspension state in which the supply of pressurized oil to the working equipment is suspended;

a lock switch that makes the oil-pressure cut valve perform the switching between the supply state and the suspension state; and a control device that controls the switching of the oil-pressure cut valve, the method comprising:

judging a lock state of the working equipment by considering the status of the lock switch;

judging whether or not the work machine is traveling; and at least one of:

issuing an alert urging that the working equipment be locked by operating the lock switch; and actuating the oil-pressure cut valve to suspend the pressure oil, when the work machine is judged to be traveling and the working equipment is judged not to be in the lock state, the judging, issuing and actuating steps being performed by the control device.

* * * * *